US010940923B2

(12) United States Patent
Langham

(10) Patent No.: US 10,940,923 B2
(45) Date of Patent: Mar. 9, 2021

(54) KAYAK WITH SIDE MOUNTED MOTORS

(71) Applicant: Fred Langham, Antwerp, OH (US)

(72) Inventor: Fred Langham, Antwerp, OH (US)

( * ) Notice: Subject to any disclaimer, the term of this patent is extended or adjusted under 35 U.S.C. 154(b) by 0 days.

(21) Appl. No.: 16/376,496

(22) Filed: Apr. 5, 2019

(65) Prior Publication Data

US 2019/0337598 A1 Nov. 7, 2019

Related U.S. Application Data

(60) Provisional application No. 62/667,757, filed on May 7, 2018.

(51) Int. Cl.

| | |
|---|---|
| ***B63B 35/00*** | (2020.01) |
| ***B63B 34/20*** | (2020.01) |
| ***B63H 21/17*** | (2006.01) |
| ***B63H 5/125*** | (2006.01) |
| *B63B 34/26* | (2020.01) |

(52) U.S. Cl.

CPC ..... *B63B 34/20* (2020.02); *B63H 5/125* (2013.01); *B63H 21/17* (2013.01); *B63B 34/26* (2020.02); *B63B 2221/00* (2013.01)

(58) Field of Classification Search

CPC .... B63H 5/125; B63H 5/1258; B63H 20/007; B63H 20/02; B63H 20/08; B63H 20/106; B63H 20/12; B63H 20/14; B63H 21/12; B63H 21/17; B63H 25/42; B63H 25/425; B63B 35/71; B63B 2035/71; B63B 2035/715; B63B 2221/00

USPC ..... 440/1, 6, 7, 49, 53, 55, 61 S, 63, 64, 65, 440/75, 79, 84, 86, 87; 114/144 R, 114/144 RE, 144 A, 144 E, 150, 343, 347, 114/364

See application file for complete search history.

(56) References Cited

U.S. PATENT DOCUMENTS

| | | | | |
|---|---|---|---|---|
| 2,213,520 | A * | 9/1940 | Gentry | B63H 20/007 440/7 |
| 5,131,875 | A * | 7/1992 | Lee | B63H 20/007 114/153 |
| 9,840,312 | B1 * | 12/2017 | Clark | B63B 49/00 |
| 10,155,579 | B2 * | 12/2018 | Marchio | B63H 20/06 |
| 2005/0155999 | A1 * | 7/2005 | Gasper | B60R 9/08 224/406 |
| 2018/0072383 | A1 * | 3/2018 | Montague | B63B 32/60 |

* cited by examiner

*Primary Examiner* — Daniel V Venne
(74) *Attorney, Agent, or Firm* — Schaffer, Schaub & Marriott, Ltd.

(57) ABSTRACT

The side mounted motors are attached to the left side and the right side of the kayak. The invention further comprises a pair of unique clamps for attaching the pair of side mounted motors to the kayaks. The unique clamps are configured to adjust the side mounted motors both horizontally and vertically to regulate placement and depth of the side mounted motors. In a preferred embodiment, the clamp has interchangeable wedges that conform to different profiles of a kayak to provide a more secure fit.

6 Claims, 3 Drawing Sheets

KAYAK WITH SIDE MOUNTED MOTORS

CROSS REFERENCE TO RELATED APPLICATION

The present application claims the benefit of U.S. Provisional Patent Application, 62,667,757, filed May 7, 2018. All subject matter contained in the application is expressly incorporated herein.

TECHNICAL FIELD

This invention relates to a unique kayak. More specifically, the invention is a kayak with side mounted motors.

BACKGROUND OF THE INVENTION

Kayaks can be difficult to stabilize and maneuver. It can also be difficult to enter or reenter a kayak especially, for example, after falling off of the kayak. In addition, it can be difficult to initially sit on a kayak or get back on the kayak if falling off.

In view of the disadvantages inherent in the known types of kayak configurations now present in the prior art, the present invention provides an improved motor-powered kayak system.

SUMMARY OF THE INVENTION

This invention is directed to a propulsion and steering system for kayaks which incorporates a pair of motors which are located on the sides of the kayak. The side mounted motors are attached to the left side and the right side of the kayak. The invention further comprises a pair of unique clamps for attaching the pair of side mounted motors to the kayaks. The unique clamps are configured to adjust the side mounted motors both horizontally and vertically to regulate placement and depth of the side mounted motors. In a preferred embodiment, the clamp has inter-changeable wedges that conform to different profiles of a kayak to provide a more secure fit.

DETAILED DESCRIPTION OF THE INVENTION

The present invention provides a combination propulsion and steering system for a kayak with independent control of a pair of motors. The direction of propulsion and speed of each motor controls the speed and steering of the kayak.

The propulsion and steering for the kayak is a pair of motors are mounted to the side of the kayak so that the motors may be adjusted both horizontally and vertically to regulate the placement and depth of the propellers. The motors pivot vertically in the event a subsurface obstruction is encountered in either forward or reverse travel.

Figure 1:
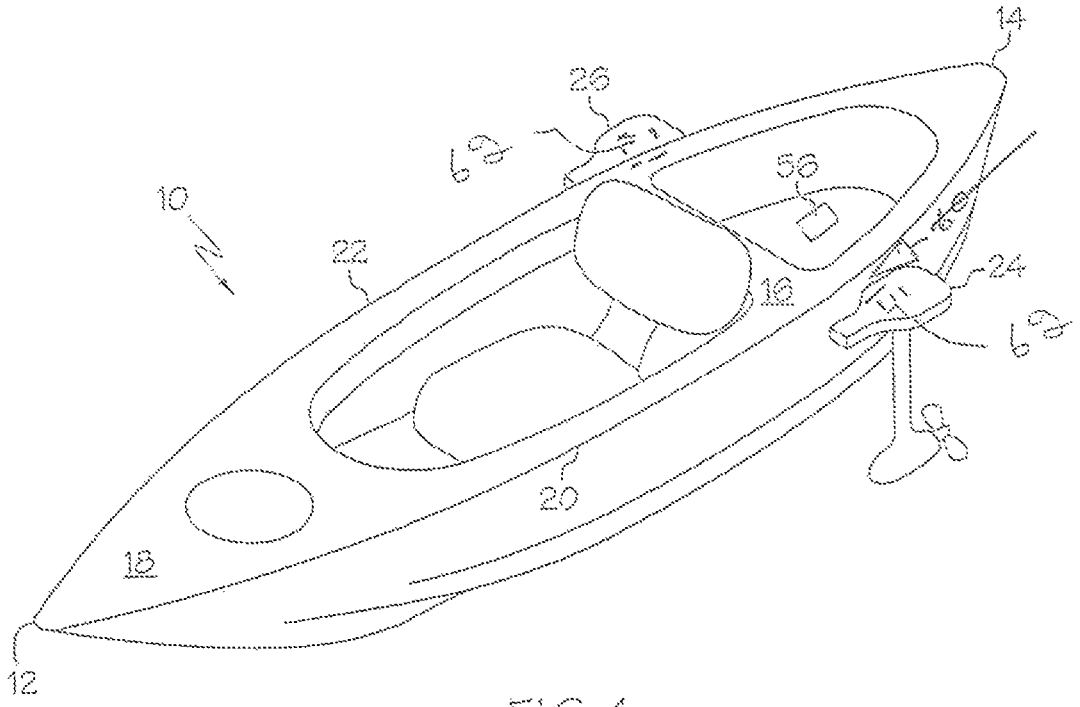
FIG. 1 is a perspective view of the kayak with side mounted motors according to this invention.

FIG. 1 is a perspective view of the kayak with side mounted motors according to this invention. FIG. 1 shows motored powered kayak 10 according to this invention.

Kayak 10 has a front 12, a back 14, and a transverse intermediate region 16. Kayak 10 also has a top 18 and a left side 20 and a right side 22. Intermediate region 16 is provided between front 12 and back 14. Intermediate region extends from left side 20 to right side 22. Motor 24 is attached to left side 20 and motor 26 is attached to right side 22. Conventional mounts, bolts and nuts are used to attach motors 24 and 26 to kayak 10. Also shown in quick disconnect plug 60.

Figure 2:
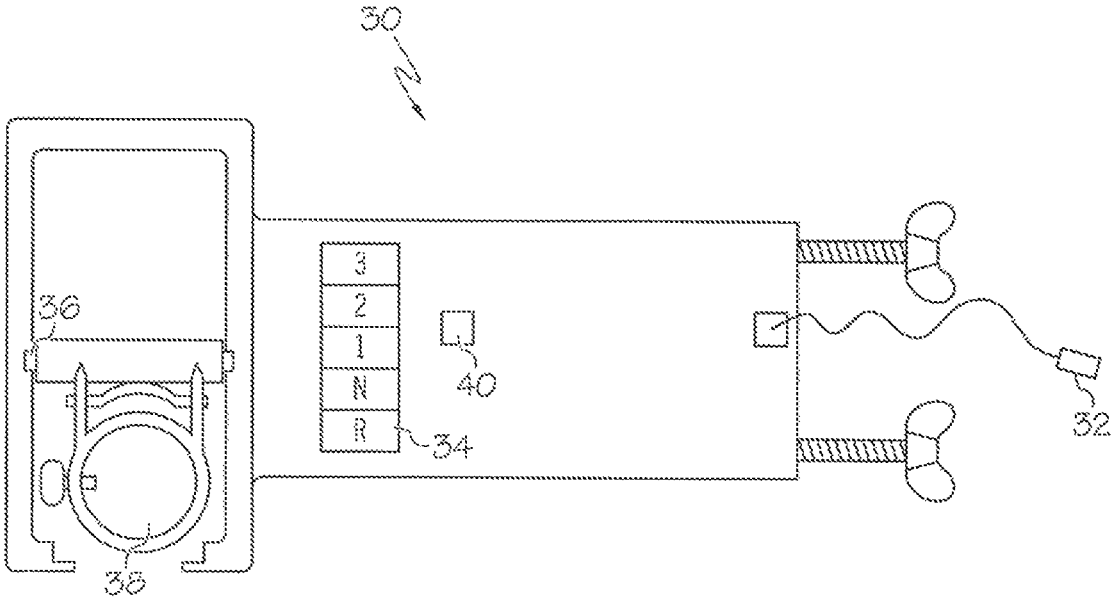
FIG. 2 is a top view of a motor control assembly according to this invention.

FIG. 2 shows motor control assembly 30 of this invention.

Figure 3:
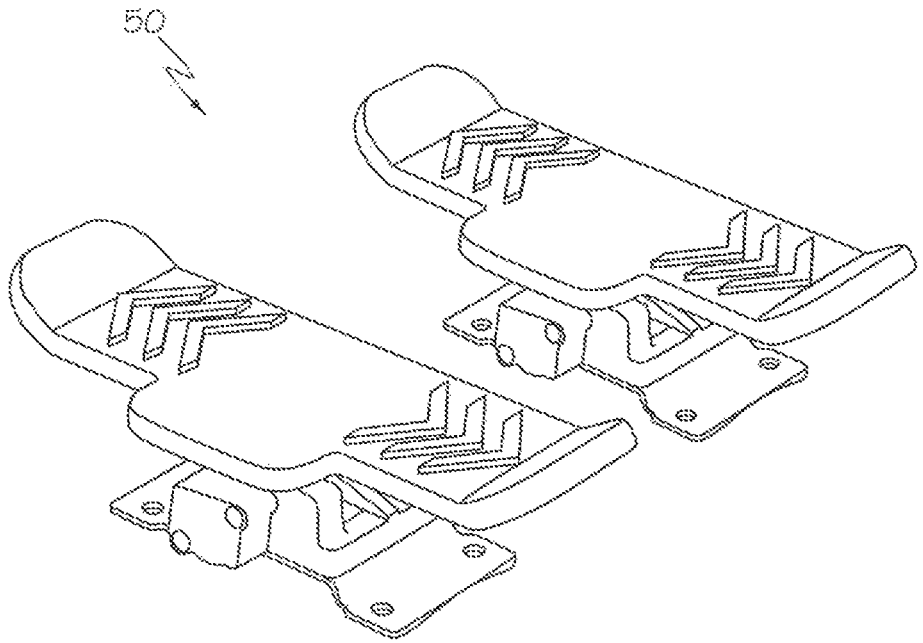
FIG. 3 is a top view of motor control foot pedals according to this invention.

FIG. 3 is a top view of motor control foot pedals 50 according to this invention.

The following is a specific embodiment of the kayak and assembly.

Assembly 30 includes tether safely switch 32 and speed control switch 34. Spring loaded up and down switch 36 also is shown. Opening 38 for a trolling motor also is shown. Contact switch 40 insures that motors 24 and 26 do not run in the up position.

Assembly 30 may have interchangeable wedges that will conform to different profiles of a kayak to give a more secure fit. Assembly 30 will have a height control adjustment to place the motor in the correct depth of water depending on the type of kayak. Assembly 30 has a spring-loaded switch 36 that rotates the motor in an "up" position when not in use and a "down" position when in use. Contact switch 40 that will insure the motor will not run in the "up" position so the propellers will not cause damage or injury to someone. Also, the tether safety switch is built into the assembly and is hand operated individually on both sides with forward and reverse speeds. It has a quick disconnect plug for the motor for easy removal. Conventional cables and connections connect assembly 30 to motor 24 and 26.

FIG. 3 is a top view of motor control foot pedals 50 according to this invention. Foot pedals 50 control left and right movement by rotating motors 24 and 26. Conventional cables and connectors connect foot pedals 50 to motors 24 and 26 (mounts for the side mounted motors are conventional).

FIG. 3 shows motor control foot pedals 50 according to this invention. Foot petals 50 control propulsion and steering for kayak 10 along with assembly 30. Pedals 50 and assembly 30 include circuitry for actuating each of the motors and for regulating both the direction of thrust and the speed of the motors independently of one another. Each foot control pedal includes contact switches for initiating activation of a motor either in a forward or reverse direction and further includes a pair of control circuits for regulating the speed of the motor in either a forward or reverse direction. Wherein the motor control assembly and the pair of motor control foot pedals are configured to cooperate with each other to control the propulsion and steering of the kayak.

Motors 24 and 26 may be electrical motors or gas driven motors.

Motors 24 and 26 are mounted to kayak 10 to allow selective horizontal and vertical adjustment of the motors so as to adjust the height of the props with respect to the waterline. A pivotable vertical support allows each motor to move vertically in the event any subsurface obstruction is encountered thereby preventing any damage to the prop associated with each motor. This provides a combination propulsion and steering system. Independent control of the motors through foot pedals and assembly 30 initiates activation of each motor independently of one another but also controls the direction of propulsion and the speed of each motor. The speed and steering are positively controlled through the operation of the foot control pedals and assembly 30. Battery 56 is connected to motors 24 and 26 if they are electrical motors.

I claim:

1. A motor-powered kayak comprising a kayak and side mounted motors:

wherein the kayak has a front side, an aft side and left side and a right side;

wherein the side mounted motors are configured to provide propulsion and steering to the kayak;

wherein the side mounted motors are attached to the left side and the right side of the kayak;

a motor control assembly for controlling propulsion and steering of the kayak; and a pair of motor control foot pedals for controlling propulsion and steering of the kayak;

wherein the motor control assembly and the pair of motor control foot pedals are connected to the side mounted motors to cooperate with each other to control the propulsion and steering of the kayak;

wherein the motor control assembly has a spring-loaded switch that rotates the motor in an up position when not in use and in a down position when in use.

2. A motor-powered kayak according to claim 1 further comprising a contact switch configured to stop the motor in the up position.

3. A motor-powered kayak according to claim 1 further comprising a tether safety switch that can attach to an operator that will stop the side mounted motors if the operator falls out of the watercraft.

4. A motor-powered kayak according to claim 1 further comprising a speed control switch built into the motor control assembly, configured to hand operated individually on both sides with forward and reverse speeds.

5. A motor-powered kayak according to claim 1 wherein the side mounted motors are electric motors.

6. A motor-powered kayak according to claim 1 wherein the side mounted motors are gas driven motors.

* * * * *